United States Patent [19]

Budzik

[11] 4,008,835

[45] Feb. 22, 1977

[54] ANTITHEFT LOCKING STRAP FOR CLOTHING

[76] Inventor: Daniel A. Budzik, 211 May St., Elmhurst, Ill. 60126

[22] Filed: Nov. 5, 1975

[21] Appl. No.: 629,101

[52] U.S. Cl. ..... 223/85; 223/92

[51] Int. Cl.[2] ..... A47J 51/095; E05B 69/00

[58] Field of Search ..... 223/85, 88, 92, 87, 223/DIG. 1; 211/4, 7; 24/16 PB, 30.5 P

[56] References Cited

UNITED STATES PATENTS

| | | | |
|---|---|---|---|
| 3,144,695 | 8/1964 | Budwig | 24/16 PB |
| 3,363,293 | 1/1968 | Nemrod et al. | 24/30.5 P |
| 3,530,543 | 9/1970 | Desmarais et al. | 24/16 PB |
| 3,755,822 | 9/1973 | Securer | 223/85 |

FOREIGN PATENTS OR APPLICATIONS

| | | | |
|---|---|---|---|
| 1,196,366 | 6/1970 | United Kingdom | 24/16 PB |

*Primary Examiner*—George H. Krizmanich

[57] ABSTRACT

An anti-theft locking strap is provided for preventing quick removal of a coat or other article of clothing from a clothes rack. The locking strap cooperates with conventional clothing store clothes hangers and the hang strap of the clothing to restrain the removal of the hanger from the rack and the removal of the clothing from the hanger. One end of the locking strap has an opening through which the end of the hook of the hanger is inserted. The other end of the strap is inserted through the hang strap and around the bottom of the hanger hook and then folded over and releasably secured to an intermediate portion of the locking strap.

4 Claims, 4 Drawing Figures

ANTITHEFT LOCKING STRAP FOR CLOTHING

BACKGROUND AND SUMMARY

This invention relates to an antitheft locking device for clothes, and, more particularly, to an antitheft locking strap which can be used with conventional clothes hangers and clothing hang straps.

Theft is an increasing problem in clothing stores. The primary concern of a store owner is the professional thief who steals a large number of clothes simultaneously by encircling the clothes with his arms and lifting the clothes, hangers and all, from the clothes rack. A great number of expensive coats, dresses, and other articles of clothing can be stolen in this manner in a matter of seconds. Some thieves operate by removing the clothing from the hanger, leaving the hanger on the rack. This technique is often used by shoplifters who are interested in only one or a few items.

Theft of clothing can be prevented by locking the clothing in some manner to the clothes rack or some other fixture. This solution is unsatisfactory, however, because customers must be able to remove the clothes in order to try them on. Any antitheft device which substantially interferes with the removability of the clothing may discourage a customer from sampling enough items to induce a purchase.

Both types of theft can be substantially prevented by an antitheft device which retards the removal of the hanger from the rack or the removal of the clothing from the hanger while still permitting relatively easy removal for legitimate purposes. Both the professional thief and the occasional shoplifter rely on speed to accomplish his objective and even a slight delay is often sufficient to dissuade the thief from completing the job.

The invention provides an antitheft device which releasably locks the hanger to the rack and the clothing to the hanger. The device can be manipulated to permit either the hanger or the clothing to be removed for authorized purposes, but the locking device restrains removal sufficiently to discourage theft. The locking device is attached individually to the hanger and to the clothing, and either article may be unlocked as desired. No special hangers or fixtures are required, and the device can be used with conventional hangers and does not require any alteration to the clothing.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
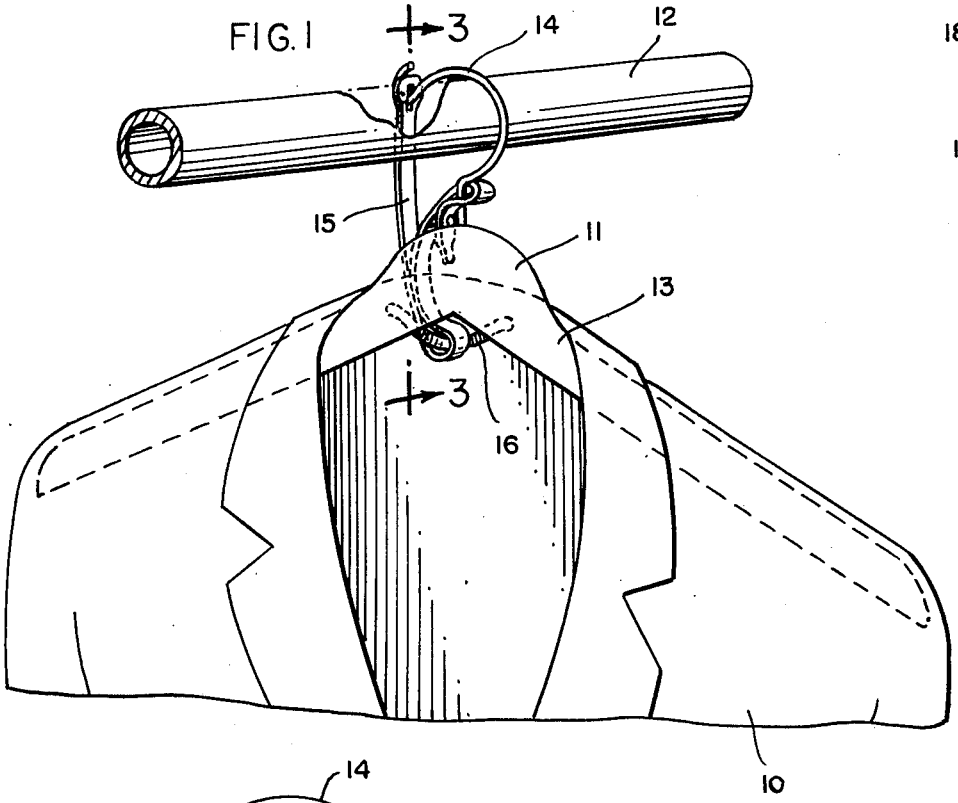
FIG. 1 is a fragmentary perspective view of an antitheft locking strap which is formed in accordance with the invention and which is attached to a coat and to a hanger.

Referring first to FIG. 1, a man's coat 10 is hung on a hanger 11 which is supported by a clothes rack or rod 12. The hanger is a conventional wooden clothes store hanger and includes a wooden body 13 and a metal hook 14. One end of an elongated locking strap 15 is releasably secured to the hanger hook 14, and the other end of the strap is looped around the hanger strap 16 of the coat and around the bottom of the hanger hook.

Figure 2:
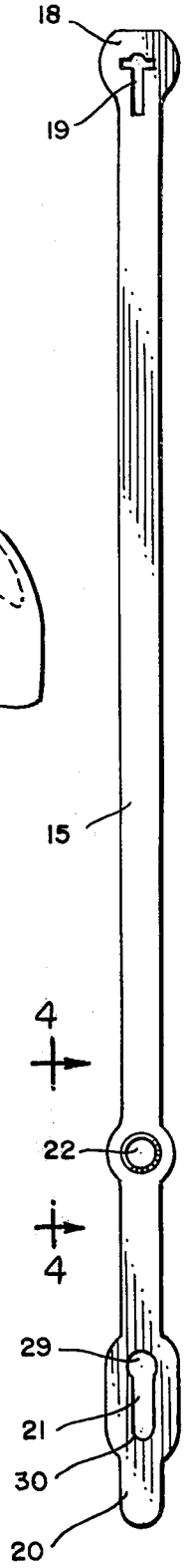
FIG. 2 is a plan view of the locking strap.
Figure 3:
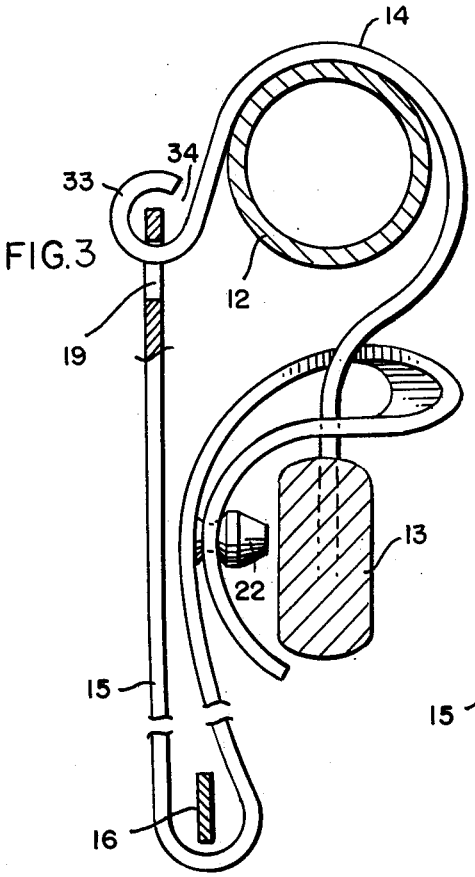
FIG. 3 is a fragmentary sectional view taken generally along the line 3—3 of FIG. 2.
Figure 4:
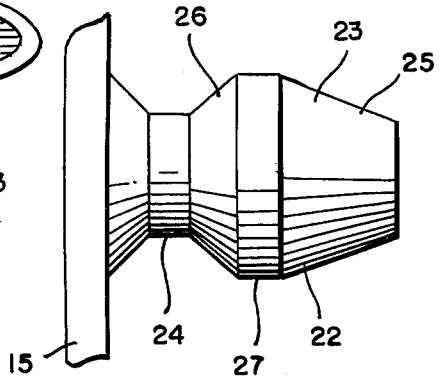
FIG. 4 is an enlarged fragmentary view taken along the line 4—4 of FIG. 3.

Referring now to FIG. 2, the locking strap includes a first end 18 which is provided with a generally T-shaped opening 19 and a second end 20 which is provided with an elongated opening or slot 21. A locking pin 22 extends outwardly from the flat strap intermediate the ends thereof but adjacent the end 20 and includes an enlarged head portion 23 (FIG. 3) and a narrow shank or waist portion 24. The head portion includes generally conical outer and inner camming surfaces 25 and 26 which diverge inwardly from a midportion 27.

The head of the locking pin is sized so that it can be forced through the large end portion 29 of the slot 21 without passing freely therethrough. The strap is made of flexible resilient material, for example, plastic, and the flexibility of the material and the camming surfaces 25 and 26 permit the head to be pushed through the enlarged end of the slot even though the outside diameter of the midportion 27 is larger than the maximum dimension of the enlarged end of the slot. The width of the other end 30 of the slot is slightly greater than the waist 31 of the locking pin but less than the width of the end 29 so that when the waist is positioned in the narrow end 30, the head of the pin will be prevented from passing through the slot.

The metal hook 14 of the hanger includes a looped end 33 (FIG. 3) which is usually provided on wooden hangers, and the end of the looped end is spaced from the hook at 34. The spacing 34 is desirably approximately the same or slightly less than the thickness of the locking strap.

The locking strap may be attached to the hook 14 either before or after the coat is hung on the hanger. The length of the slot 19 is approximately the same as the outside diameter of the curved end 33 of the hook, and the strap can quickly be attached to the hook by inserting the curved end of the hook through the slot and pulling the strap until it passes through the space 34. Once the end of the strap passes through the space 34, the strap is secured against inadvertent removal from the hook. The strap must be pulled through the space 34 in order to remove it from the hook.

The other end of the strap is passed through the hang strap 16 of the coat, upwardly behind the wooden body 13 of the hanger and around the lower end of the hanger hook. This end of the strap is secured to the lower end of the hanger hook by pushing the head of the locking pin through the enlarged end 29 of the slot 21 and then pulling the waist portion of the pin into the narrow end of the slot.

Removal of the hanger from the rack is prevented by the strap. Both ends of the strap are secured to the hanger hook and thereby prevent the hanger hook from being removed from the rack.

Removal of the coat is also prevented by the strap. If the coat is removed from the hanger, the strap still connects the coat to the hanger, which is locked to the rack. The coat can be removed only by unlocking one or both ends of the locking strap. However, this procedure is sufficiently time-consuming that it is unlikely that the removal of the coat will go undetected. The locking strap will almost surely prevent large-scale, simultaneous removal of a number of coat by a professional thief. On the other hand, when it is desired to remove the coat for legitimate purposes, for example, when a prospective buyer wishes to try on the coat, either of the ends of the locking strap can be disconnected from the hanger hook by either the salesman or the customer to permit removal of the coat.

If desired, the end 20 of the locking strap can be connected to the hang strap of the coat rather than to the bottom of the hanger hook. This can be done merely by inserting the end of the locking strap through the hang strap of the coat, reversely folding the end portion of the locking strap, and inserting the locking pin through the slot 21.

Although I have described the invention with reference to a man's coat, it will be apparent that the invention is suitable for use with any article of clothing that is hung on a hanger. Further, although in the specific embodiment of the invention illustrated the locking strap is attached to the hang strap of the clothing, it will be understood that the locking strap can also be attached to the label or other loop-providing means on the coat, and the term "hang strap" as used herein is intended to encompass such structure.

I claim:

1. In combination, a clothes hanger having a hook supported by a hanger rack, an article of clothing supported by the hanger and having a loop-providing opening therein, and an elongated antitheft locking strap, the locking strap having a first end portion which is provided with an opening through which the end of the hanger hook is inserted, an intermediate portion, a second end portion which is inserted through the loop of the clothing and around the hook of the hanger, and means for releasably securing the second end portion to the intermediate portion whereby both ends of the strap are secured to the hanger hook and the locking strap prevents removal of the hanger from the rack and removal of the coat from the hanger.

2. The structure of claim 1 in which the securing means comprises a pin on the locking strap which is insertable through an opening in the end portion, the pin having an enlarged head which restrains withdrawal of the pin from the opening.

3. The structure of claim 2 in which the opening in the end portion is a longitudinally extending elongated slot having a narrow end adjacent said other end of the strap and an enlarged end, the enlarged end being sized to permit the head of the pin to be inserted therethrough and the narrow end being sized to prevent withdrawal of the head.

4. The structure of claim 1 in which the locking strap is formed from flexible and resilient plastic.

* * * * *